US005813711A

United States Patent [19]

Sauvagnat

[11] Patent Number: 5,813,711

[45] Date of Patent: Sep. 29, 1998

[54] CLOSURE DEVICE FOR CONTROLLING A DOOR LOCK IN PARTICULAR FOR THE DOOR LOCK OF AN OVEN

[75] Inventor: René Sauvagnat, Hohberg, Germany

[73] Assignee: Premark FEG L.L.C., Wilmington, Del.

[21] Appl. No.: 571,692

[22] Filed: Dec. 13, 1995

Related U.S. Application Data

[63] Continuation of Ser. No. 299,531, Sep. 1, 1994, abandoned.

[51] Int. Cl.[6] ..... E05B 15/02

[52] U.S. Cl. ..... 292/341.17; 292/DIG. 69; 219/722

[58] Field of Search ..... 292/202, 340, 292/341.15, 341.17, DIG. 69, 254; 219/722–724

[56] References Cited

U.S. PATENT DOCUMENTS

| | | | |
|---|---|---|---|
| 3,504,144 | 3/1970 | Horner | 219/723 X |
| 3,691,329 | 9/1972 | Ball | 219/722 X |
| 3,995,899 | 12/1976 | Tippy et al. | 292/254 |
| 4,101,750 | 7/1978 | Doner | 219/724 |
| 4,321,445 | 3/1982 | Kristof et al. | 219/724 |
| 4,497,993 | 2/1985 | Aoyama | 219/724 |
| 4,511,780 | 4/1985 | Okamura | 219/724 |
| 4,672,160 | 6/1987 | Katoh | 219/724 |

FOREIGN PATENT DOCUMENTS

| | | |
|---|---|---|
| 3838917A1 | 11/1988 | Germany . |
| 38389179 | 5/1990 | Germany . |

*Primary Examiner*—Rodney M. Lindsey
*Attorney, Agent, or Firm*—Thompson Hine & Flory LLP

[57] ABSTRACT

The invention relates to a closure device for controlling a door lock, in particular the door lock of an oven, comprising a U-shaped grip (6) mounted on the locking side (11) of the door opposing the hinges of the door and rotatable about a vertical axis (9) relative to the door, the grip having a vertical grip arm (7) arranged at a distance from the rotational axis (9) of the grip (6), a magnet (22) being provided at the lower side of the grip arm, and a magnetic switch (18) fixed in the oven frame and connected electrically via a direct or indirect circuitry with the control members of the locking mechanism. When the door is closed, the magnet (22) and the magnetic switch (18) are opposite one another.

10 Claims, 3 Drawing Sheets

CLOSURE DEVICE FOR CONTROLLING A DOOR LOCK IN PARTICULAR FOR THE DOOR LOCK OF AN OVEN

This is a CONTINUATION of application Ser. No. 08/299,531, filed Sept. 1, 1994 now abandoned.

The invention relates to a closure device for controlling a door lock, in particular the door lock of an oven, comprising a U-shaped grip mounted on the locking side of the door lying opposite the hinges of the door and rotatable about a vertical axis relative the door, the grip having a vertical grip arm at a distance from the rotational axis of the grip, holding members located on the locking side, locking members arranged on the door frame which are displaceable along their longitudinal axes as well as pivotable and adapted to the holding members, and an actuating part mounted in the grip arm of the grip for coacting with an electrical switch in the frame or housing of the oven.

For locking or unlocking large and heavy doors for example, in commercially or industrially used ovens and similar uses, it is necessary to use a motor-driven locking system in order to achieve the locking forces or pressing forces required for the door.

To open such doors equipped with motor-driven locking systems, it is common practice to actuate a separate electrical switch mounted as a rule on the front side of the device in order to actuate the door locking system and to then open the unlocked door by hand via a door grip. To close the door, this must again be guided into the locking position with the door grip and the electrical switch for the locking system subsequentially actuated. This manner of procedure requires either two successive hand movements or a two-handed actuation by the user.

The invention is therefore based on the technical problem of providing a door grip which allows a considerably simplified operation and an effective, wear-free and integrated switch mechanism for controlling the locking of a door.

This technical problem is solved with the inventive closure device for controlling a door lock having the features of claim 1.

The inventive design of the closure device for controlling a door lock, in particular the door lock of an oven, allows a simple, one-handed and thus considerably easier operation of the door and the door locking mechanism for the user. On account of the use of a magnetic switch as an electrical control member for actuating the locking mechanism, the arrangement of the magnetic switch in the oven housing and the arrangement of the magnet in the grip arm of the grip, a mechanically wear-free, very reliable and in its dimensions very small and optically inconspicuous control system is realized which combines the switching and door grip functions.

It has been discovered to be advantageous in a preferred embodiment of the invention to arrange the vertical rotational axis of the U-shaped grip also directly on or in the locking side of the door.

It has also shown to be very advantageous for functional and ergonomic reasons to provide the fixed holder and/or the locking side and/or the U-shaped door grip with a stop which allows the rotation of the grip in one direction, but limits rotation in the other direction.

An exemplified embodiment of the invention including further details and advantageous further embodiments is described in the following with respect to the drawings, in which.

Figure 1A:
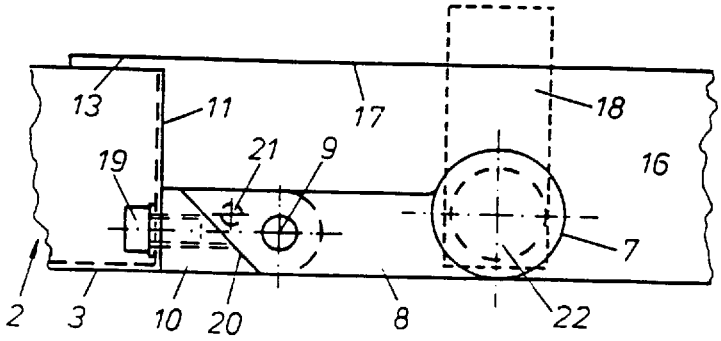
FIG. 1A to 1C show a schematic plan view of the inventive closure device for controlling a door lock in different locking positions.
Figure 1B:
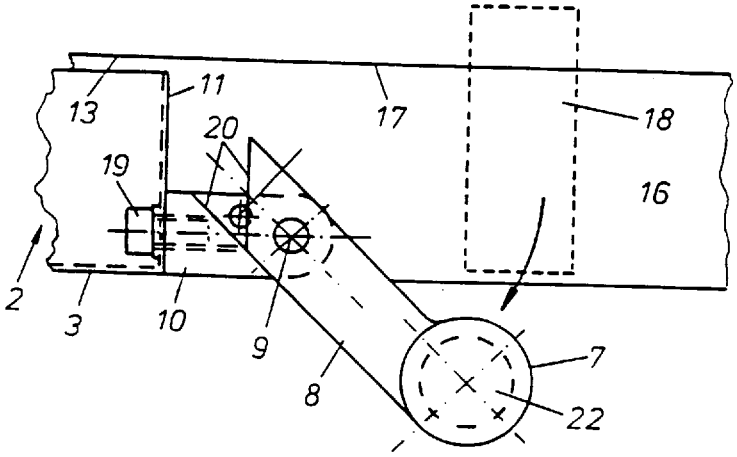
Figure 1C:
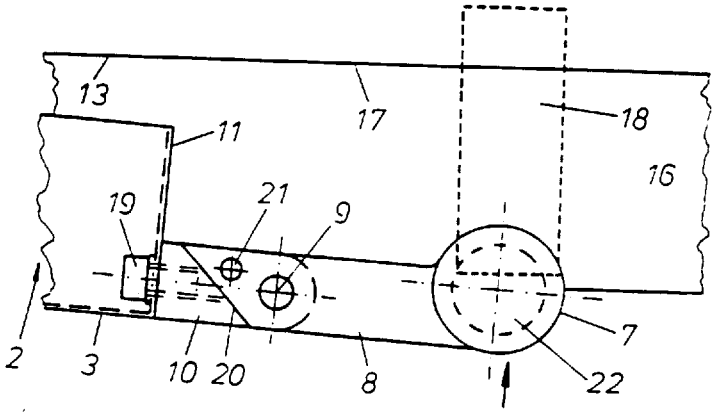
Figure 2:
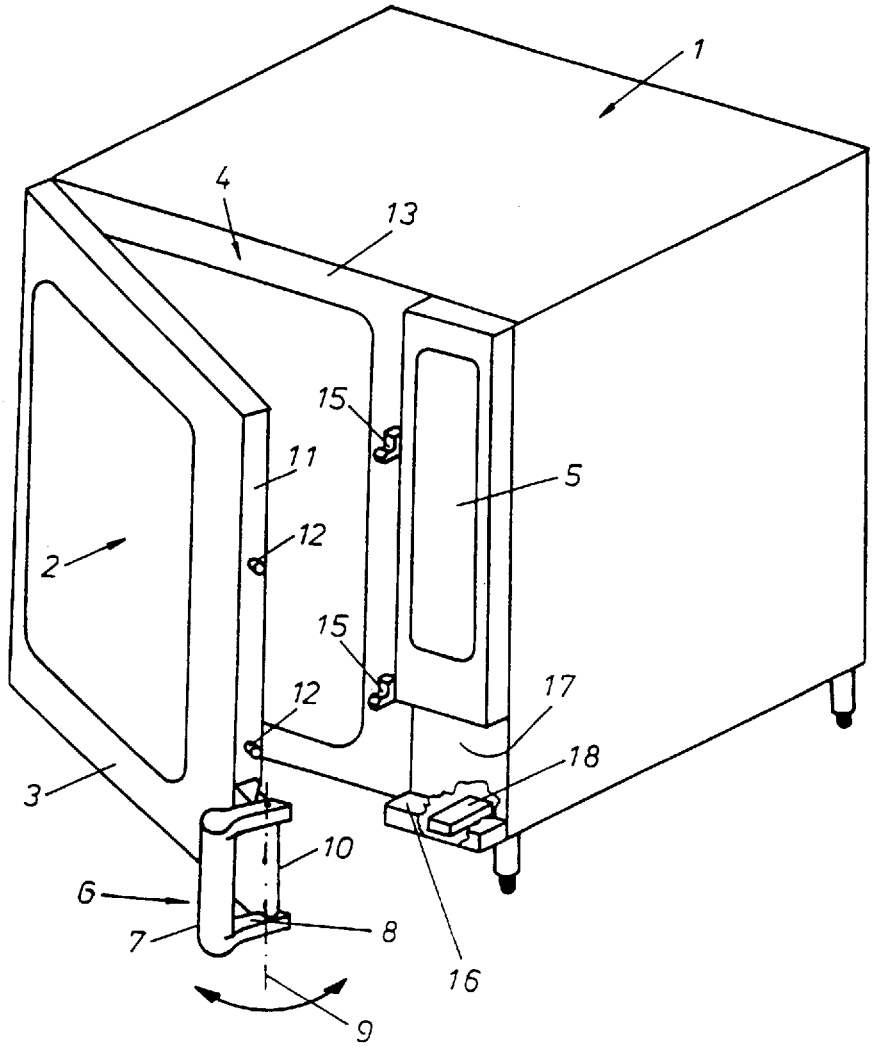
FIG. 2 shows a perspective view of an oven equipped with the inventive closure device for controlling a door lock.

FIG. 1 and 2 show the essential parts of the closure device and the component parts of an oven 1 associated with the closure device. The oven 1 has a door 2 which is pivotably connected with the front side 13 of the frame 4 surrounding the opening of the oven interior. A commonly used control housing 5 is also mounted to the front side of the oven 1. The thickness or depth of the control housing 5 and the door 2 is selected such that the forward surface of the oven 1 as a whole is flat and flush. The front surface 17 of the oven housing arranged beneath the control housing 5 adjoins flushly to the front side 13 of the frame 4 and together with the housing heal 16 beneath the front surface 17 forms a space for receiving the U-shaped grip 6 fixed by means of a fixed holder 10 to the locking side 11 of the door 2.

Figure 3B:
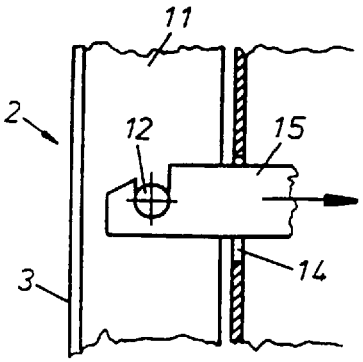
FIG. 3A and 3B show a schematic front view of the locking side of the oven door with locking members in various locking stages.
Figure 3A:
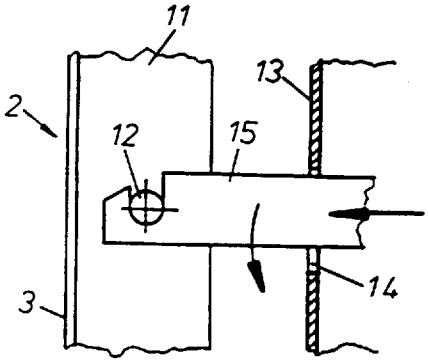
Figure 4:
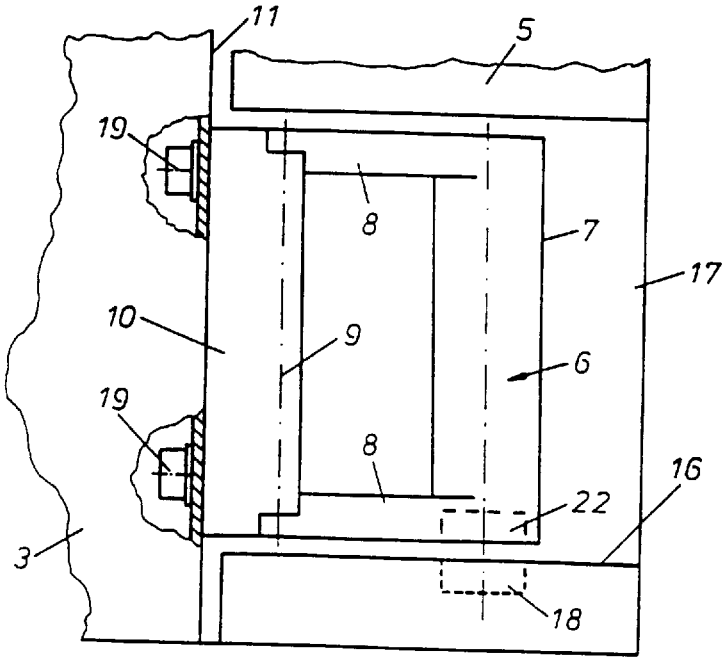
FIG. 4 shows a schematic side view of the inventive closure device.

When the door 2 is closed, the grip 6 lies in such a manner in the space formed by the control housing 5, the front surface 17 and the housing heal 16 that it is flat and flush with the front surface of the oven 1 and does not project beyond this. Two spaced holding bolts 12 are arranged on the locking side 11 of the door 2. The holding bolts 12 matched to two locking hooks 15 which project from the front side 13 of the frame, as can be seen in FIGS. 2, 3A and 3B, and are guided via openings 14 in the front side 13 of the frame into the interior of the oven, not shown, laterally of the heated oven interior. It is also conceivable to position the holding bolts 12 such that they are hidden in the locking side 11 and to provide two additional openings for the locking hooks on the inner side of the door. As indicated by arrows in FIGS. 3A and 3B, the locking hooks 15 can be moved along their longitudinal axis by means of gears and electric motors, i.e. perpendicularly to the front side 13 of the frame. Further, the locking hooks 15 are pivotable in a limited range as soon as they are moved sufficiently far out of the openings 14 in the front side 13 of the frame. As can be seen in FIG. 3A, when the door 2 is closed, the locking hooks 15 engage the holding bolts 12 mounted on the locking side 11 via an upper recess in the vicinity of the hook ends.

As can easily be recognized in FIGS. 1A to 1C and FIG. 4, a fixed holder 10 is securely fixed by means of screw connections 19 in the lower area of the locking side 11 of the door 2 at the level at the front surface 17 of the oven housing. The holder 10 has two short upper and lower horizontally machined shoulders facing to the right and to which the connecting arms 8 of the grip 6 are pivotably mounted in such a manner that the grip 6 held at the vertical grip arm 7 connecting the horizontal connecting arms 8 can be pivoted about the vertical rotational axis 9. Naturally, it is also conceivable to arrange the vertical rotational axis 9 of the grip 6 directly on or in the locking side 11.

In the depictions in FIGS. 1A to 1C, the ends of the connecting arms of the grip 6 facing the holder 10 and the short horizontally machined shoulders of the holder 10 are respectively provided with inclined sections which together form a stop 20. This stop 20 ensures that the grip 6 lying in the neutral position in FIG. 1A when the door 2 is closed cannot be pivoted further in the direction of the front surface 17, but rather closes off the front side of the grip 6 flatly with the front side 3 of the door 2 over the holder 10. Upon pulling in the direction marked with an arrow in FIG. 1B, the grip 6 can be pivoted about approximately 45° relative to the front side 3 of the door 2. The door grip 6 is held in this position by means of a spring bearing 21 mounted in the connecting arms 8 of the grip 6 and in engagement with the holder 10. In other words, the positions relative to the front side 3 of the door 2 according to FIGS. 1A and 1B, or also 1C, are stable and positions in a pivoted position between those shown, for example, in FIGS. 1A and 1B are unstable.

It can be seen in FIGS. 1A to 1C and FIG. 4 that a magnet 22 is secured by means of a screw (not shown) in a cylindrical bore in the horizontal lower side of the grip arm 7 of the grip 6. As can particularly be seen in the perspective view of FIG. 2, a magnetic switch 18 such as a so-called reed switch is provided in the interior of the housing heal 16. The magnet 22 in the grip arm 7 of the grip 6 and the magnetic switch 18 in the housing heal 16 are arranged with respect to one another such that they exactly oppose one another when the door 2 is closed. This can particularly be seen in FIG. 1A and FIG. 4. The magnetic switch 18 is electrically connected with the control members of the locking mechanism or their energy sources by means of a direct or indirect circuitry. The control members and the electrical connections of the magnetic switch 18 are not shown in the drawings.

To describe the operation of the closure device for controlling the locking of the door, one best proceeds from the completely closed position of the door according to FIG. 1A. The magnet 22 is located exactly above or opposite the magnetic switch 18. The switching condition of the magnetic switch 18 is adjusted here in such a manner that the energy supply to the control members of the locking mechanism is interrupted. To open the oven door 2, a user holds the grip arm 7 of the grip 6 and pivots this, beginning in the position according to FIG. 1A, and moving to the position according to FIG. 1B. Only the grip 6 is moved here relative to the door 2. On account of the resulting change in the magnetic flux density sensed by the magnetic switch 18, the magnetic switch 18 generates a control pulse and switches the electric door locking system to open. As can be seen in FIG. 3A, the locking hooks 15 move outwardly on account of this and unlock the door 2. By further lightly pulling at the door grip 6, the locking hooks 15 can be pivoted downwardly and release the holding bolts 12 and the door 2. The door grip 6 is held in this position by means of a spring bearing 21 or an equivalent component. The user achieves a complete opening of the door 2 by pulling further at the door grip 6.

To close the door 2, the user pivots the door grip 6 about the axis 9 relative to the door 2 up to the stop 20 (flush with door 2) in accordance with FIG. 1C and swings the door 2 towards the front side of the oven 1. In this case, the locking hooks 15 slightly pivoted downwardly engage via their inclined forward edges with the holding bolts 12 and as soon as the magnet 22 is moved over the magnetic switch 18, this is activated and the electrical locking system is switched on. As can be seen in FIG. 3B, the door 2 is pulled by means of the locking hooks 15 and the holder bolts 12 securely on to the frame front side 13 of the oven 1.

As only a change in the magnetic flux density is necessary for activating the magnetic switch 18, it is naturally equally conceivable to arrange the magnets 22 and the magnetic switch 18 in the neutral position of the door 2 in such a manner that they are at a distance from one another and only superimposed after pivoting of the door grip 6.

It is claimed:

1. A closure device for controlling a door lock comprising:

an electrically controllable locking mechanism;

a door, a door frame, the door pivotally mounted on the frame and including a locking side and hinges lying opposite the locking side;

a U-shaped grip on the locking side of the door, said grip having a vertical grip arm and being rotatable about a vertical rotational axis of the grip;

holding members arranged on the locking side of the door;

locking hook members arranged on the door frame and being pivotable and displacable along longitudinal axes thereof in response to a signal from the electronically controllable locking mechanism, and the position of the locking members corresponding to that of the holding members;

a holder extending from the locking side of the door in a fixed position for attachment of the U-shaped grip, the U-shaped grip being rotatably mounted on the holder, said grip being adapted to be rotated relative to the fixed holder and the door, in which the vertical rotational axis of the grip is arranged on the fixed holder and is distanced from both the locking side of the door and from the grip arm;

a magnet provided in a horizontal side of the grip arm for coacting with a magnetic switch secured in the frame and located at a distance from the locking side of the door and at the same level as the grip arm, the magnet and magnetic switch being arranged with respect to one another such that they adjacently oppose one another when the door is closed; and wherein the magnetic switch supplies the signal for controlling the locking hook members on the door frame and is electrically connected with the electronically controllable locking mechanism.

2. The closure device for controlling a door lock according to claim 1, wherein the vertical rotational axis of the U-shaped grip is directly associated with the locking side.

3. The closure device for controlling a door lock according to claim 2 further comprising a stop which allows free rotation of the grip in one direction but limits rotation in an opposite direction, wherein the stop is associated with the fixed holder.

4. The closure device for controlling a door lock according to claim 2 further comprising a stop which allows free rotation of the grip in one direction but limits rotation in an opposite direction, wherein the stop is associated with the locking side.

5. The closure device for controlling a door lock according to claim 2 further comprising a stop which allows free rotation of the grip in one direction but limits rotation in an opposite direction, wherein the stop is associated with the U-shaped grip.

6. The closure device for controlling a door lock according to claim 1 further comprising a stop which allows free rotation of the grip in one direction but limits rotation in an opposite direction, wherein the stop is associated with the fixed holder.

7. The closure device for controlling a door lock according to claim 1 further comprising a stop which allows free rotation of the grip in one direction but limits rotation in an opposite direction, wherein the stop is associated with the U-shaped grip.

8. The closure device of claim 1 wherein the magnet is provided in an upper horizontal side of the grip arm.

9. The closure device of claims 1 wherein the magnet is provided in a lower horizontal side of the grip arm.

10. The closure device for controlling a door lock according to claim 1 further comprising a stop which allows free rotation of the grip in one direction but limits rotation in an opposite direction, wherein the stop is associated with the locking side.

* * * * *

UNITED STATES PATENT AND TRADEMARK OFFICE

CERTIFICATE OF CORRECTION

PATENT NO. : 5,813,711

DATED : September 29, 1998

INVENTOR(S) : Sauvagnat

It is certified that error appears in the above-identified patent and that said Letters Patent is hereby corrected as shown below:

On the title page, please add Item [30] Foreign Application Priority Data:
--Sept. 1, 1993 German ..... P4329494.4 --.

Signed and Sealed this

Sixteenth Day of February, 1999

*Attest:*

*Attesting Officer*

*Acting Commissioner of Patents and Trademarks*